US006508297B1

(12) United States Patent
Erana

(10) Patent No.: US 6,508,297 B1
(45) Date of Patent: Jan. 21, 2003

(54) MOTE MOULDING MACHINE

(75) Inventor: Agustin Arana Erana, Alava (ES)

(73) Assignee: Loramendi, S.A., Vitoria (ES)

( * ) Notice: Subject to any disclaimer, the term of this patent is extended or adjusted under 35 U.S.C. 154(b) by 61 days.

(21) Appl. No.: 09/713,961

(22) Filed: Nov. 16, 2000

(30) Foreign Application Priority Data

Oct. 20, 2000 (ES) ..... 9902548

(51) Int. Cl.[7] ..... B22C 15/02
(52) U.S. Cl. ..... 164/322; 164/40; 164/130
(58) Field of Search ..... 164/29, 130, 180, 164/188, 213, 322, 40

(56) References Cited

U.S. PATENT DOCUMENTS

| | | | | | |
|---|---|---|---|---|---|
| 12,885 | A | * | 5/1855 | Bonvillain | 427/368 |
| 976,833 | A | * | 11/1910 | Ronceray | 164/188 |
| 3,238,576 | A | * | 3/1966 | Taccone | 164/180 |
| 3,266,405 | A | * | 8/1966 | Lawrence | 164/29 |
| 3,434,527 | A | * | 3/1969 | Bedell | 164/493 |
| 3,802,486 | A | * | 4/1974 | Otaki | 164/187 |
| 4,437,507 | A | * | 3/1984 | Seeley | 164/173 |
| 4,744,404 | A | * | 5/1988 | Sakoda et al. | 164/180 |
| 6,092,585 | A | * | 7/2000 | Larsen et al. | 164/130 |

FOREIGN PATENT DOCUMENTS

| | | | | |
|---|---|---|---|---|
| DE | 2602547 A1 | * | 9/1976 | 164/322 |
| EP | 0013511 | * | 7/1980 | 164/29 |

* cited by examiner

*Primary Examiner*—Jan H. Silbaugh
*Assistant Examiner*—Emmanuel S. Luk
(74) *Attorney, Agent, or Firm*—Katten Muchin Zavis Rosenman

(57) ABSTRACT

Mounted on plate (9), associated to the machine's compacting and ejection piston is pattern plate (10), which incorporates stops (11) restored by springs (12), with an ejection plate (13) placed between said pattern plate (10) and plate (9), aided by guiding elements (14) and complemented by hold down plates (15) which correspond to the holes of the pattern plate. Inside compacting rammer (6) are mounted four ejectors (17) embodied as hydraulic cylinders which, by means of hold down plates (15) attached to ejection plate (13) compact the sand in the holes to then eject the mote. Therefore, the ejection plate has a compacting stroke (Y) prior to the ejection stroke (Z). The machine is thus particularly well suited for efficient moulding of motes having round or otherwise shaped deep holes, without requiring the use of cores.

4 Claims, 3 Drawing Sheets

MOTE MOULDING MACHINE

OBJECT OF THE INVENTION

The object of the invention are improvements applicable to vertical mote moulding machines, that is, machines in which the motes are produced and exit the moulding chamber in a vertical position, in which position they arrive at the casting station.

These improvements allow an efficient moulding of holes, whether round or with other geometries, in which depth is greater than the cross section without requiring the use of cores. Thus the mote may be directly produced with the required conical or otherwise shaped protrusions, perfectly compacted and without said protrusions being deteriorated or destroyed in demoulding.

For this purpose the pattern plate is provided with an ejection plate which aids in compacting the sand in the deep holes of the pattern plate and aids in ejection and separation of the mote from said pattern plate.

BACKGROUND OF THE INVENTION

Mote moulding machines for casting are generally provided with a chamber of rectangular cross section closed on one end by a movable wall, which may swivel to allow exit of the moulded mote, while the other end is closed by a plate associated to the plate for compacting and later ejecting the mote. The remaining walls of the moulding chamber are generally fixed, although PCT ES/99/00320 describes a moulding chamber of adjustable volume in which the lateral walls are mobile.

In these mote moulding machines, whether of fixed or variable volume, the plate connected to the compacting rammer is attached to the pattern plate. When the pattern plate has deep holes, corresponding to the identically shaped protrusions in the mote obtained, compacting the sand in these holes usually entails problems, to which must be added the risk of damage or wear of said protrusions when demoulding, that is, when separating the mote from the pattern plate.

The above problem is such that un many cases cores are required to obtain the Protrusions in the mote, which assemble the mote "a posteriori" entailing two additional operations: obtaining the core itself and attaching it to the mote.

DESCRIPTION OF THE INVENTION

The improvements disclosed by the invention solve the above described problem in a fully satisfactory manner.

To this end the improvements comprise including in the pattern plate an ejection plate which is placed between said pattern plate and the plate connected to the rammer which compacts and later ejects the mote.

The ejection plate is provided with hold down plates matching the deep holes of the pattern plate, in which the sand to be compacted must enter. Additionally, the ejection plate is provided with guide elements which prevent it from pitching.

Additionally, the pattern plate itself is provided with stops which allow the ejection plate to perform a compacting stroke before ejecting the mote.

As mentioned before, once the sand is compacted, including that contained in the holes of the pattern plate, the mote is ejected. Such ejection is performed by means of pneumatic pushers mounted on the compacting rammer and parallel to its shaft. Said pneumatic pushers act against the ejection plate and the latter, aided by the hold down plates opposite the holes of the pattern plate and of its stops, initiates the aforementioned compacting and ejection strokes.

Resetting of the system, i.e. recovery of the pattern plate stops and of the ejection plate itself is achieved by springs.

DESCRIPTION OF THE DRAWINGS

Further characteristics and advantages of the present invention will become apparent in view of the accompanying drawings where, for purposes of illustration only, the following is shown.

PREFERRED EMBODIMENT OF THE INVENTION

Figure 1:
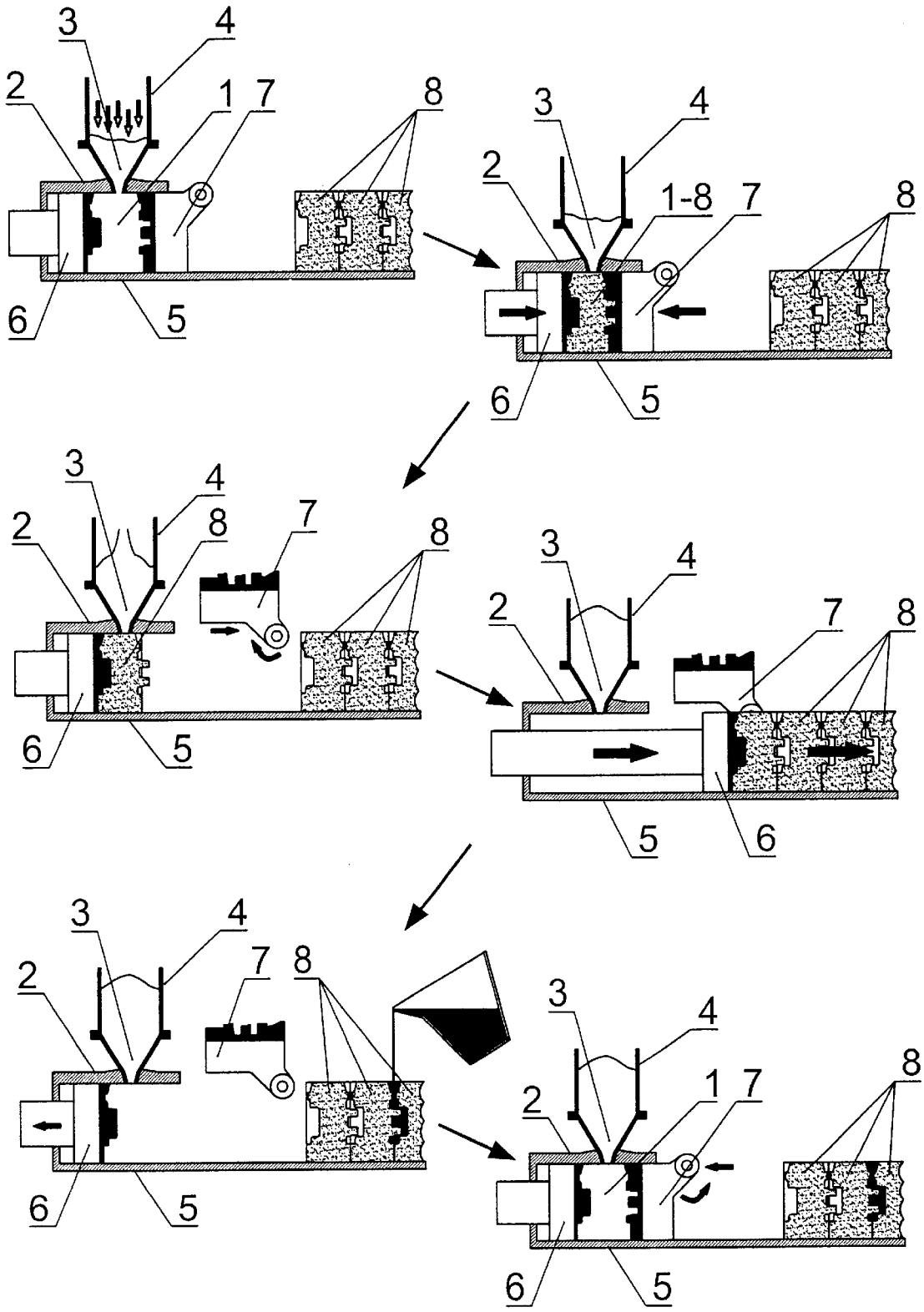
FIG. 1 shows a six-stage diagram showing the full cycle of a conventional sand mote moulding chamber, as described in the background section.

Based on a conventional machine such as shown in FIG. 1, where the moulding chamber is labeled (1) and is provided with: a top wall (2) which bears the sand discharge opening (3) from the corresponding hopper (4); a bottom wall (5); a wall associated to the corresponding piston (6) and a swiveling wall (7) which in turn may move longitudinally. The improvements of the invention consist of the inclusion in pattern plate (10) of an ejection plate (13).

Figure 2:
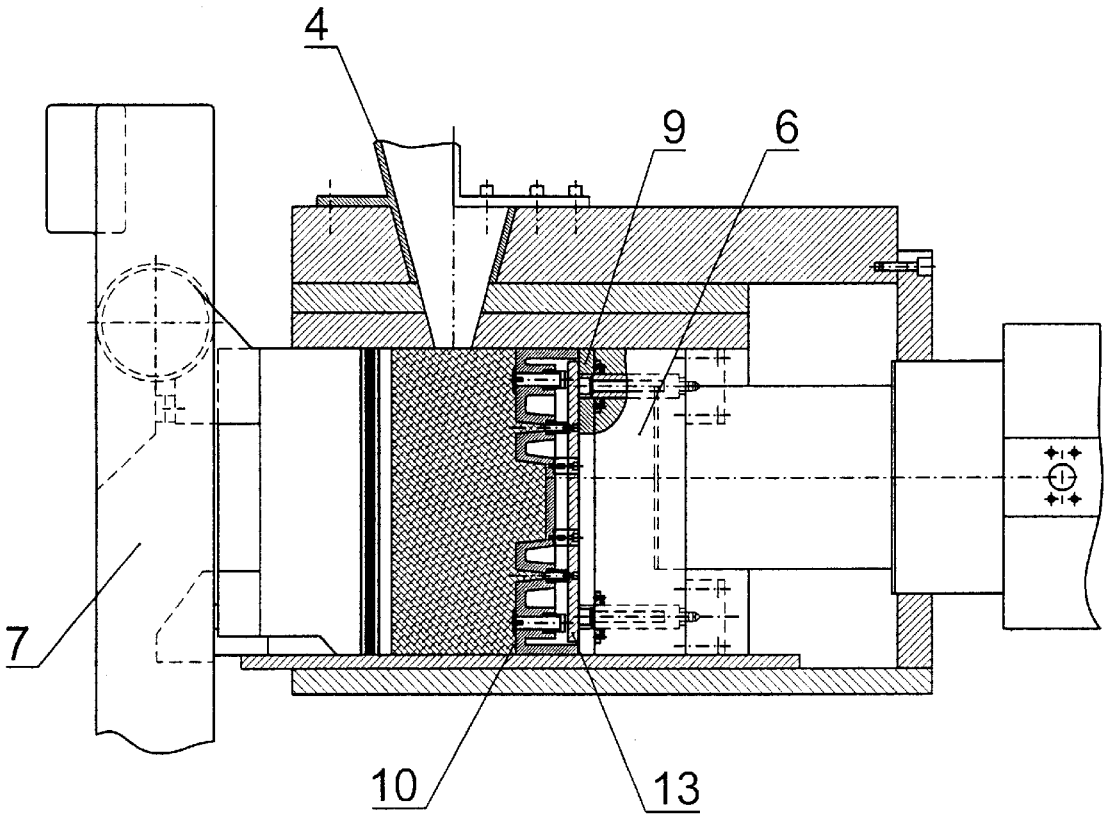
FIG. 2 shows a longitudinal section of the moulding chamber showing a sectional view of the pattern plate and a partially sectioned view of the rammer and plate attached to it.
Figure 3:
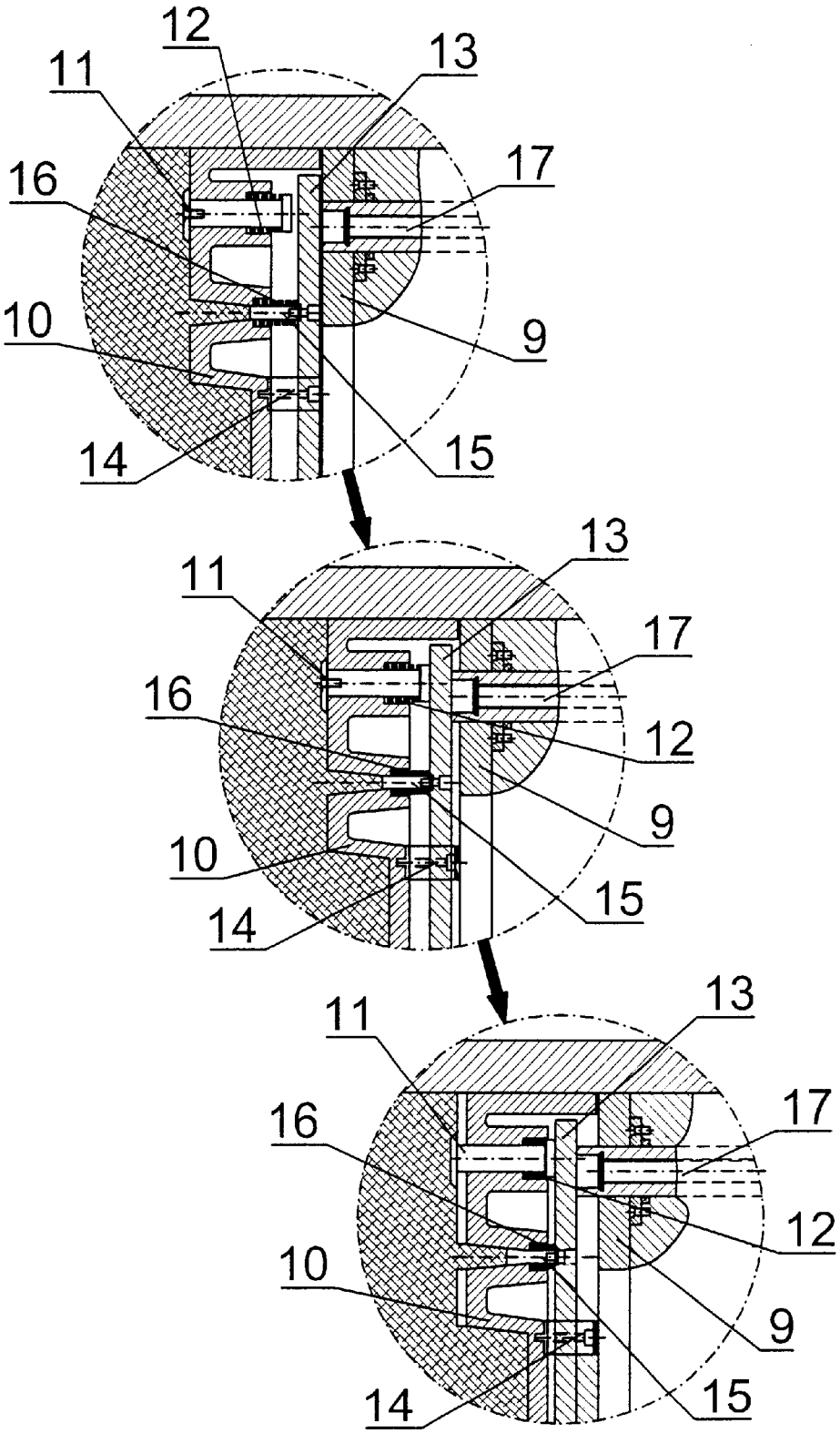
FIG. 3 shows in three enlarged sectional views the operational cycle: initial position, pressing or compacting and ejection.

More specifically, and as shown in FIGS. 2 and 3, to plate (9) associated to the compacting and ejection rammer (6) is mounted pattern plate (10) which is provided with stops (11) which are restored to their positions by springs (12).

Between said pattern plate (10) and plate (9) is provided an ejection plate (13) conveniently guided by elements (14) which prevent it from pitching. Ejection plate (13) is complemented by hold down plates (15) opposite the deep holes of the pattern plate.

Inside the compacting rammer (6) are provided four ejectors (17) consisting of four hydraulic cylinders which, in the compacting stage and by means of hold down plates (15) attached to ejection plate (13), compact the sand in the deep holes and in the following stage eject the mote, the latter stage involving the action of stops (11).

Thus, the ejection plate has a compacting stroke (Y) which ensures compacting of the sand in the deep holes before ending the ejection stroke (Z).

As mentioned above, resetting of the system after the pneumatic pushers withdraw is achieved by springs (12) and (16), coaxial to stops (11) and hold down plates (15) respectively.

In short, the operation of the system is as follows:

In the initial stage the general compacting of the mote occurs by means of rammer (6), to which is attached pattern plate (10). In the following stage of pressing or compacting the sand in the orifices, pushers (17) bear on ejection plate (13) and the latter, by means of hold down plates (15), compacts the sand in the holes during the compacting stroke (Y). In the ejection stage the ejection plate continues its compacting stroke (Z) causing the separation of the mote from the pattern plate, separation which is aided by hold down plates (15) and stops (11).

What is claimed is:

1. A mote molding machine comprising:

a molding chamber in which a portion of sand is introduced, said chamber bounded by a movable wall having a first pattern plate and an extractor rammer having a second pattern plate, said second pattern plate having at least one deep depression, said first and second pattern plates forming a mote mold from said portion of sand when said portion of sand is compacted between said first and second pattern plates;

a support plate positioned between said extractor rammer and said second pattern plate;

an ejection plate positioned between said support plate and said second pattern plate and including guide elements associated with said second pattern plate for guiding movement of said ejection plate relative to said second pattern plate, said ejection plate further including at least one hold down plate positioned opposite said at least one deep depression in said second pattern plate for aiding in the compacting of sand in said at least one deep depression; and at least one pneumatic pusher housed in said extractor rammer and attached to said extraction plate for movement of said extraction plate relative to said support plate;

wherein said second pattern plate further includes at least one stop for controlling movement of said ejection plate relative to said second pattern plate;

wherein during a compacting stroke, said extractor rammer causes said ejection plate to move toward said second pattern plate and said at least one hold down plate to compress said portion of said sand in said at least one deep depression and to form said mote mold in said molding chamber, said compacting stroke occurring until said ejection plate contacts said at least one stop; and wherein during an ejection stroke, said extractor rammer causes said ejection plate to bear against said at least one stop and cause said mote mold to separate from said second pattern plate.

2. A mote molding machine in accordance with claim 1, wherein said at least one stop is spring-biased.

3. A mote molding machine in accordance with claim 1, wherein said second pattern plate further comprises a plurality of deep depressions.

4. A mote molding machine in accordance with claim 3, further comprising a plurality of hold down plates positioned opposite said plurality of deep depressions.

* * * * *

UNITED STATES PATENT AND TRADEMARK OFFICE

CERTIFICATE OF CORRECTION

PATENT NO. : 6,508,297 B1
DATED : January 21, 2003
INVENTOR(S) : Agustin Arana Erana It is certified that error appears in the above-identified patent and that said Letters Patent is hereby corrected as shown below:

Title page,
Item [30], Foreign Application Priority Data, change the date to read -- 11/19/1999 --

Signed and Sealed this

Seventh Day of September, 2004

JON W. DUDAS
*Director of the United States Patent and Trademark Office*